US006072448A

United States Patent [19]

Kojima et al.

[11] Patent Number: 6,072,448

[45] Date of Patent: Jun. 6, 2000

[54] PLASMA DISPLAY DEVICE DRIVEN IN A SUBFRAME MODE

[75] Inventors: Ayahito Kojima; Masaya Tajima; Hirohito Kuriyama; Katsuhiro Ishida; Akira Yamamoto, all of Kawasaki, Japan

[73] Assignee: Fujitsu Limited, Kawasaki, Japan

[21] Appl. No.: 08/941,107

[22] Filed: Sep. 30, 1997

[30] Foreign Application Priority Data

Nov. 27, 1996 [JP] Japan ..... 8-315721
Aug. 6, 1997 [JP] Japan ..... 9-212316

[51] Int. Cl.[7] ..... G09G 3/28

[52] U.S. Cl. ..... 345/63; 340/60

[58] Field of Search ..... 345/60, 63, 147, 345/77, 148, 55, 67, 68, 76

[56] References Cited

U.S. PATENT DOCUMENTS

| | | | |
|---|---|---|---|
| 5,317,334 | 5/1994 | Sano | 345/148 |
| 5,343,215 | 8/1994 | Tanaka | 345/63 |
| 5,583,527 | 12/1996 | Fujisaki et al. | 345/60 |
| 5,874,932 | 2/1999 | Nagaoka et al. | 345/60 |
| 5,936,355 | 8/1999 | Kim | 345/63 |
| 5,943,032 | 8/1999 | Nagaoka et al. | 345/63 |

FOREIGN PATENT DOCUMENTS

| | | |
|---|---|---|
| 0 344 623 | 12/1989 | European Pat. Off. . |
| 0 653 740 | 5/1995 | European Pat. Off. . |
| 655722 A1 | 5/1995 | European Pat. Off. . |

OTHER PUBLICATIONS

*Patent Abstracts of Japan*, vol. 96, No. 7, Jul 31, 1996 & JP 08–076716 A (Pioneer Electronics Corp.), Mar. 22, 1996.

*Primary Examiner*—Dennis-Doon Chow
*Attorney, Agent, or Firm*—Staas & Halsey LLP

[57] ABSTRACT

The plasma display device has a plasma display panel and a driving part for driving the plasma display panel in a subframe mode. The driving part has a circuit for calculating the length of one frame based on one period of a vertical synchronizing signal introduced along with an image signal from an external device, a circuit for calculating the total number of sustaining pulses contained in one frame based on a brightness information contained in the image signal, and a circuit for calculating the length of one driving period required for displaying one frame. The length of one frame and the length of one driving period thus obtained are then compared in a comparing circuit. If the one frame length is found to be shorter than the one driving length, the total number of sustaining pulses or the number of scan lines will be reduced so that the one frame length becomes shorter than the length of one driving period, thus avoiding an extraordinary display.

17 Claims, 15 Drawing Sheets

Fig.2(a) DRIVING WAVEFORM FOR ADDRESS ELECTRODE

Fig.2(b) DRIVING WAVEFORM FOR X ELECTRODE

Fig.2(c) DRIVING WAVEFORM FOR Y ELECTRODE

Fig.3

| | SF1 | SF2 | SF3 | SF4 |
|---|---|---|---|---|
| SUS0 | 1 | 2 | 4 | 8 |
| SUS1 | 1 | 2 | 4 | 9 |
| SUS2 | 1 | 2 | 5 | 9 |
| SUS3 | 1 | 2 | 5 | 10 |
| SUS4 | 1 | 3 | 5 | 10 |
| SUS5 | 1 | 3 | 5 | 11 |
| | | | | |
| | | | | |
| SUS127 | 16 | 32 | 64 | 128 |

IMAGE SIGNAL
SUSTAINING PULSE NUMBER DETECTING CIRCUIT
11
DRIVING PERIOD LENGTH CALCU-LATING CIRCUIT
12
Tg
Vsync
FRAME LENGTH CALCULATING CIRCUIT
10
Tv
COMPARING CIRCUIT
14
S
CHANGING CIRCUIT
16

Fig.7

| ADDRESS | SF1 | SF2 | SF3 | SF4 | SF5 | SF6 | SF7 | SF8 | TOTAL NUMBER OF SUSTAINING PULSES |
|---|---|---|---|---|---|---|---|---|---|
| MCBC127 | 3 | 6 | 12 | 24 | 48 | 96 | 96 | 96 | 381 |
| MCBC126 | 3 | 6 | 12 | 24 | 47 | 95 | 95 | 95 | 377 |
| MCBC125 | 3 | 6 | 12 | 23 | 47 | 94 | 94 | 94 | 373 |
| MCBC124 | 3 | 6 | 12 | 23 | 46 | 93 | 93 | 93 | 369 |
| MCBC123 | 3 | 6 | 11 | 23 | 46 | 92 | 92 | 92 | 365 |
| - - - - - | - - - - - | - - - - - | - - - - - | - - - - - | - - - - - | - - - - - | - - - - - | - - - - - | - - - - - |
| MCBC 1 | 1 | 2 | 4 | 8 | 17 | 33 | 33 | 33 | 131 |
| MCBC 0 | 1 | 2 | 4 | 8 | 16 | 32 | 32 | 32 | 127 |

PLASMA DISPLAY DEVICE DRIVEN IN A SUBFRAME MODE

BACKGROUND OF THE INVENTION

1. Field of the Invention

The present invention relates to a plasma display device, and in particular, it relates to a plasma display device driven in a subframe mode.

2. Description of the Related Art

A plasma display panel (referred to as PDP, below) is a kind of flat display widely used, for example, in various OA apparatus and TVs, since the panel structure thereof is very simple and all the elements of the panel structure can be made using a thick film printing technique.

A conventional color PDP of a triple-electrode type is structured with two glass plates arranged in parallel with each other to form a discharge space. On one of the glass plates, address electrodes and a phosphor are provided while X electrodes and Y electrodes are provided on another glass plate to intersect each other at right angles. A so-called "subframe mode" is known to drive such a PDP of the triple-electrode type. In this driving mode, one frame is divided into, for example, 8 subframes, each of which has a sustaining discharge period. The respective sustaining discharge periods of the subframes are set to a ratio of 1:2:4:16:32:64:128 (although the ratio is constant in this example, there is no need for it to be always constant), and these subframes are combined to realize a grey-scale display.

In such a plasma display device driven in the subframe mode, the brightness of the PDP is determined by the total number of sustaining pulses applied to the PDP during one frame. That is, it is determined by the total number of sustaining pulses in all the subframes of one frame. In actuality, as the number of sustaining pulses applied to electrodes during one frame increases, the brightness of the display increases. Therefore, to display a bright image on the plasma display device, a large number of sustaining pulses are necessary during one frame while a small number of sustaining pulses are enough to display an image having a relatively low brightness.

PDPs are usually driven by image signals supplied from an external device, such as a TV tuner and a personal computer, connected to the PDPs. The driving frequencies of these external devices are not the same as each other. Since the length of one frame of a PDP is determined depending on one period of a driving signal, that is, a vertical synchronizing signal, introduced from an external device, the real length of one frame of the PDP varies depending on what kind of external device is connected with the plasma display device.

According to the variation of the frame length as mentioned above, a deficiency arises as follows. When the frame length becomes shorter than that expected for the plasma display device, the length of one driving period of the plasma display device required to display one frame exceeds the real frame length when displaying a very bright image with a large number of sustaining pulses. This results in an extraordinary display on the plasma display device.

On the other hand, when the frame length becomes much longer than that expected in advance for the plasma display device, the length of one driving period of the plasma display device required to display one frame becomes shorter than the expected value. This results in the unnecessary extension of a quiescent period in one frame, thus lowering the brightness of the display.

As mentioned above, the prior art plasma display device driven in a subframe mode is disadvantageous in that it does not have enough flexibility to accommodate various types of external devices having different driving frequencies.

SUMMARY OF THE INVENTION

The present invention has been made to overcome the above mentioned disadvantage of the prior art plasma display device. Therefore, an object of the present invention is to provide a plasma display device driven in a subframe mode, the device having enough flexibility to accommodate various types of external devices having different driving frequencies.

Another object of the present invention is to provide a plasma display device which is capable of reducing the total number of sustaining pulses to avoid an extraordinary display when the length of one frame is shorter than the length of one driving period required to display one frame.

Still another object of the present invention is to provide a plasma display device which is capable of increasing the total number of sustaining pulses to increase brightness of the display when the length of one frame is longer than the length of one driving period required to display one frame.

Still another object of the present invention is to provide a plasma display device, which is capable of adjusting the length of the driving period in a manner to shorten the length of one frame by reducing or increasing the number of scan lines of the plasma display device.

In order to realize the above mentioned objects, the plasma display device according to one feature of the present invention has a plasma display panel and a driving part for driving the plasma display panel in a subframe mode. The driving part further has a circuit for calculating the length of one frame for display according to one period of a vertical synchronizing signal introduced with an image signal from an external device, a circuit for detecting the total number of sustaining pulses contained in one frame according to brightness information contained in the image signal and a circuit for calculating one driving period of the plasma display device required to display one frame according to the total number of sustaining pulses thus obtained. The calculated length of one frame and that of one driving period are compared each other by a comparing circuit. The driving part further has a circuit for changing the total number of sustaining pulses contained in one frame according to the compared result from the comparing circuit. In a case where the calculated length of one frame is shorter than that of one driving period, the changing circuit reduces the total number of sustaining pulses to avoid an extraordinary display. On the contrary, when the calculated length of one driving period is shorter than that of one frame length, the changing circuit increases the total number of sustaining pulses to increase the brightness of the panel.

A circuit is further provided for finding the lapse of a constant time since the comparing circuit found a change in the comparing result. The changing circuit changes the total number of sustaining pulses contained in one frame after the time lapse finding circuit detects the lapse of the constant time.

The frame length calculating circuit, the driving period calculating circuit and the comparing circuit may be made by a microprocessor unit and a media in which a program is stored to operate the microprocessor unit as these circuits.

In another feature of the present invention, the plasma display device has a plasma display panel and a driving part for driving the plasma display panel in a subframe mode.

The driving part further has a ROM table having a plurality of addresses, in each of which a combination of the number of sustaining pulses in the respective subframes is stored, a circuit for calculating the length of one frame for display according to one period of a vertical synchronizing signal introduced with an image signal from an external device, a circuit for detecting the total number of sustaining pulses contained in one frame based on an address of the ROM table, the address which corresponds to a brightness information contained in the image signal, and a circuit for calculating the length of one driving period of the plasma display panel necessary for displaying one frame based on the total number of sustaining pulses thus detected. The calculated length of one frame and that of one driving period are compared each other by a comparing circuit. The driving circuit further has a circuit for changing the address of the ROM table according to the compared result from the comparing circuit. In a case where the calculated length of one frame is shorter than that of one driving period, the changing circuit changes the address of the ROM table in a manner to reduce the total number of sustaining pluses contained in the address so that the length of the driving period becomes shorter than the length of one frame. On the contrary, when the calculated length of one driving period is shorter than that of one frame length, the changing circuit changes the address of the ROM table in a manner to increase the total number of sustaining pluses contained in the address so that enough brightness can be obtained.

A circuit is further provided for finding the lapse of a constant time since the comparing circuit found a change in the comparing result. The changing circuit changes the address of the ROM table after the time lapse finding circuit detects the lapse of the constant time.

The frame length calculating circuit, the driving period calculating circuit and the comparing circuit may be made by a microprocessor unit and a media in which a program is stored to operate the microprocessor unit as these circuits.

In still another feature of the present invention, the plasma display device of the present invention has a plasma display panel having a plurality of light emitting cells arranged in form of a matrix and a driving part for driving the plasma display panel in a subframe mode while scanning the plurality of light emitting cells line-sequentially. The driving part further has a circuit for calculating the length of one frame for display according to one period of a vertical synchronizing signal introduced with an image signal from an external device, a circuit for detecting the total number of sustaining pulses contained in one frame according to brightness information contained in the image signal and a circuit for calculating one driving period of the plasma display panel required to display one frame according to the total number of sustaining pulses thus obtained. The calculated length of one frame and that of one driving period are compared each other by a comparing circuit. The driving part further has a circuit for changing the total number of scan lines, which are scanned in line-sequence, according to the result from the comparing circuit. In a case where the calculated length of one frame is shorter than that of one driving period, the changing circuit reduces the total number of scan lines to shorten the addressing periods uniformly in one frame, and so the length of one driving period, to avoid an extraordinary display. On the contrary, when the calculated length of one driving period is shorter than that of one frame length, the changing circuit increases the total number of scan lines to enlarge a display range.

A circuit is further provided for finding the lapse of a constant time since the comparing circuit found a change in the comparing result. The changing circuit changes the total number of scan lines after the time lapse finding circuit detects the lapse of the constant time.

The frame length calculating circuit, the driving period calculating circuit and the comparing circuit may be made by a microprocessor unit and a media in which a program is stored to operate the microprocessor unit as these circuits.

In still another feature of the present invention, the plasma display device has a plasma display panel and a driving part for driving the plasma display panel in a subframe mode. The driving part further has a circuit for calculating a length of one frame for display according to one period of a vertical synchronizing signal which is introduced from an external device along with an image signal, a circuit for calculating a maximum number of sustaining pulses, which can be driven without causing any extraordinary display, based on the length of one frame thus obtained and for calculating the maximum brightness according to the maximum number of sustaining pulses, and a circuit for comparing the maximum brightness with a predetermined referential brightness. A circuit is further provided for calculating a number of sustaining pulses which corresponds to the predetermined referential brightness when the maximum brightness is found to be different from the predetermined referential brightness, and for setting the calculated number of sustaining pluses to be the maximum number of sustaining pluses. As a result, a constant brightness can be obtained without being affected by the variation of driving frequencies of external devices.

The present invention further provides a driving method for the plasma display panel. In this method, the length of one frame for display is calculated according to one period of a vertical synchronizing signal which is input from an external device along with an image signal. At the same time, the total number of sustaining pulses contained in one frame is detected based on brightness information contained in the image signal. Then, the length of one driving period of the plasma display panel necessary for displaying one frame is calculated based on the total number of sustaining pulses detected in the previous step. Thereafter, the calculated frame length and the length of one driving period are compared, and the compared result is used to change the total number of sustaining pulses. In a case where the frame length is shorter than the length of one driving period, the total number of sustaining pulses will be reduced so that the one frame length becomes shorter than the length of one driving period. As a result, an extraordinary display caused by the driving period longer than the frame length can effectively be avoided.

BRIEF DESCRIPTION OF THE DRAWINGS

The above objects and features of the present invention will be more apparent from the following description of the preferred embodiments with reference to the accompanying drawings, wherein:

FIG. 2(*d*) is a view showing the definition of a reset period, addressing period and sustaining discharge period in one frame;

FIG. 3 is a view showing an example of stored data in a ROM table for controlling the brightness of the PDP;

FIG. 5(*b*) is a view showing the detailed structure of the common driver control part shown in FIG. 5(*a*);

FIG. 7 is a view showing an example of stored data in a ROM table which is used for explaining embodiments of the present invention;

FIG. 14(*b*) is a view showing the detailed structure of the common driver control part shown in FIG. 5(*a*) for realizing the seventh embodiment.

DESCRIPTION OF THE PREFERRED EMBODIMENTS

Before describing the embodiments of the present invention, the related art and the disadvantages thereof will be described with reference to the related figures.

Figure 1:
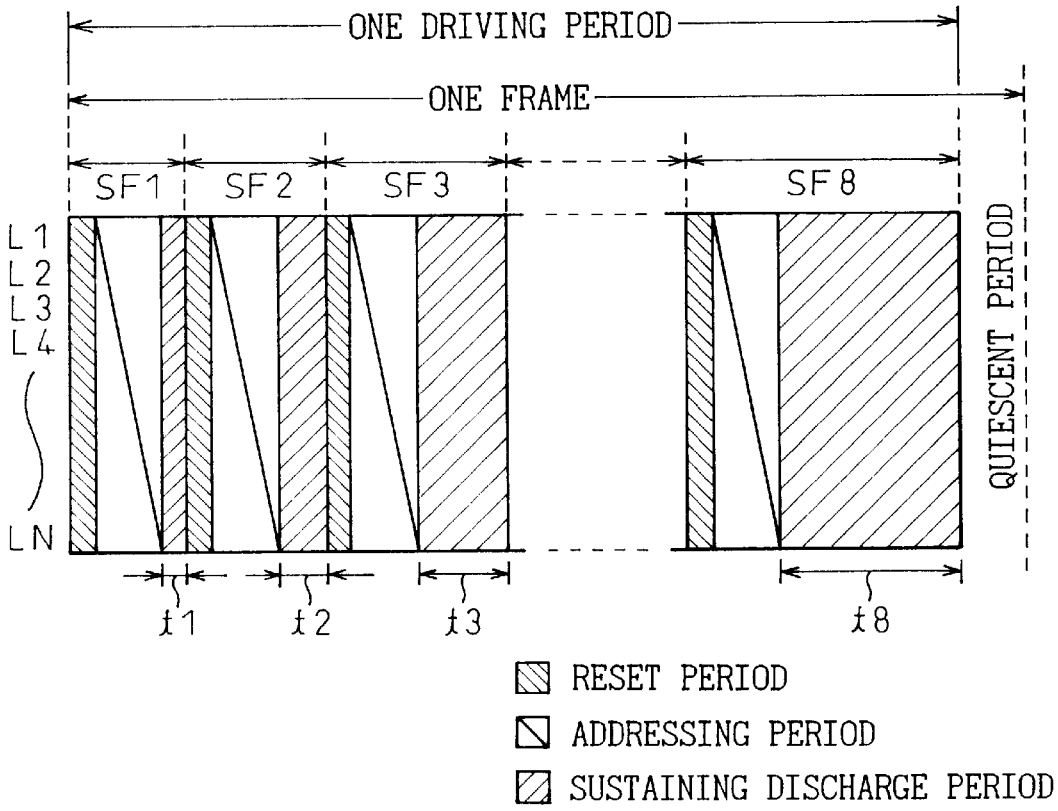
FIG. 1 is a view for explaining a subframe mode for driving a PDP.

FIG. 1 is a schematic view for explaining the frame structure of the subframe mode. In this example, one frame is divided into 8 subframes SF1 to SF8, each subframe having three kinds of period, that is, a reset period, an addressing period and a sustaining discharge period. Each length of the first two periods is constant in every subframe while the sustaining discharge periods t1 to t8 are different with a constant ratio in each subframe. In FIG. 1, L1, L2, . . . and LN denote horizontal scan lines and the diagonals in the address period of each subframe imply that horizontal scan lines L1, L2, . . . and LN are selectively driven line-sequentially.

A conventional driving method driven in the subframe mode will be explained next with reference to the waveform diagrams shown in FIGS. 2*a* to 2*d*.

Figure 2D:
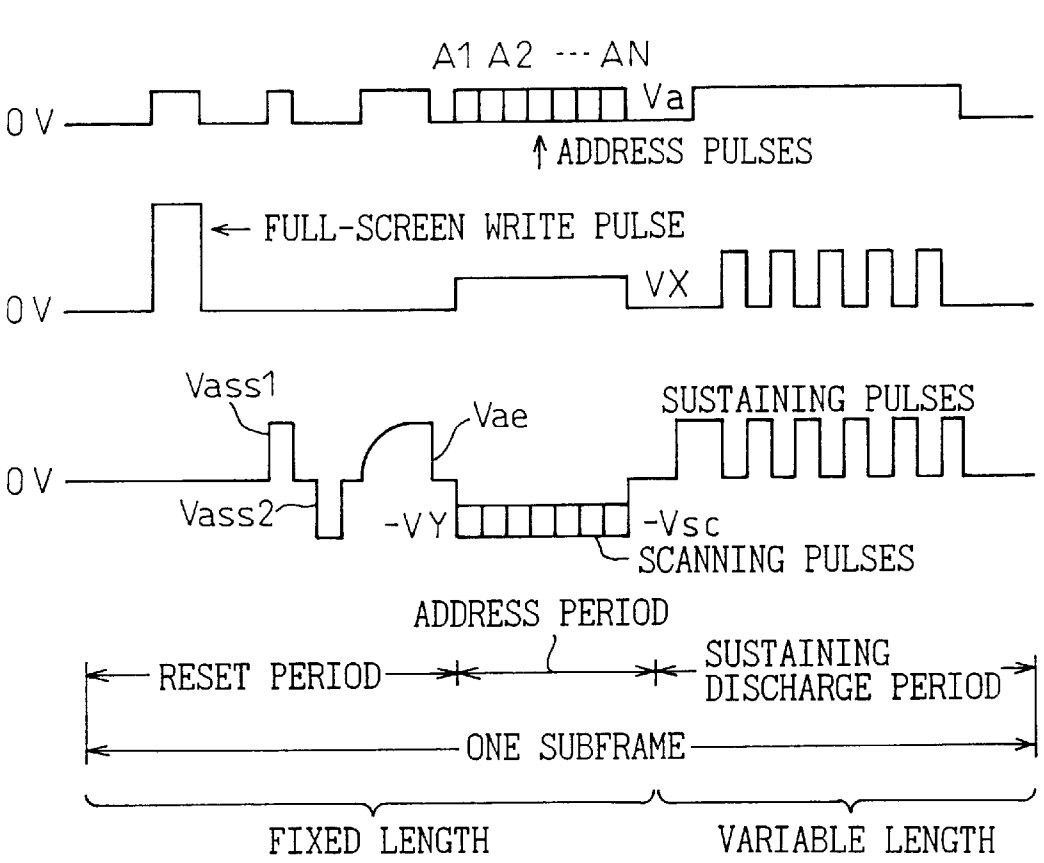
FIGS. 2(*a*) to 2(*c*) are views showing examples of waveforms applied on address electrodes, X electrodes, and Y electrodes of the PDP.

FIG. 2*a* is a timing chart of a waveform applied to address lines within one subframe, FIG. 2*b* is that applied to X electrodes, and FIG. 2*c* is that applied to Y electrodes. In addition, FIG. 2*d* defines the reset period, the addressing period, and the sustaining discharge period in the respective waveform charts. In the explanation below, voltages are indicated by way of example and therefore, the method is not restricted to the voltage values described.

In the reset period, all the Y electrodes are set to a 0 V level at first. At the same time, in order to form enough potential, a full-screen writing pulse of about +330 V level is applied to all the X electrodes while maintaining all the address electrodes at about the +110 V level. As a result, a discharge takes place in all the cells regardless of the previous display states of these cells.

Thereafter, the address electrodes and the X electrodes are set to 0-level to cause a discharge in all the cells. In this case, the potentials across the electrodes are kept 0 V level so that the discharge ceases as a result of self saturation without forming any wall charges. This discharge is called a self-erasure discharge. As a result of this self-erasure discharge, all the cells in the panel are reset to a uniform state having no wall charge. This reset period is provided to set all the cells into the same state regardless of the lighting states in the previous subframe and to stabilize the address (write) discharge in the next address period.

In this reset period, a step may be provided to apply the first auxiliary pulse Vass1, the second auxiliary pulse Vass2 and the auxiliary erasure pulse Vae on the Y electrodes, in order to eliminating the wall charges on the Y electrodes. In this case, pulses of +110 V level are applied to the address electrodes during the application of the auxiliary pulses.

During the address period, the panel is scanned line-sequentially in order to turn on or off the cells according to display data, thus conducting address discharge. First, the Y electrodes are scanned line-sequentially with pulses (referred to as scan pulses, below) of about −150 to −160 V while keeping the voltage of the X electrodes about +50 V. At the same time, pulses of about +60 V (referred to as address pulses, below) are selectively applied to address electrodes, which correspond to cells to cause sustaining discharge, that is, to cause selective light emission. As a result, an electric potential of about 210 to 220 V, which is enough to cause discharge, is generated across the address electrodes to which the address pulses are applied and the Y electrodes to which the scan pulses are applied, thus causing address-discharges across these electrodes. On the other hand, since the electric potential across the X electrodes and the Y electrodes, on which the scan pulses are applied, are about 200 V to 210 V, which is about 10 V less than that of across the address electrodes and the Y electrodes, no self-discharge takes place across them. However, discharge takes place between the X electrodes and the Y electrodes using the address-discharges as a trigger, thus forming wall charges on parts of the dielectric layer corresponding to the cross points of the X and Y electrodes.

During the sustaining discharge period (referred to as a sustaining period, below), pulses of about +180 V (referred to as sustaining pulses, below) are applied to the X electrodes and the Y electrodes alternately. As a result, sustaining discharges take place between the X and Y electrodes where the wall charges have been accumulated during the previous address period, thus displaying an image of one subframe on the PDP. In this situation, a voltage of about 110 V is applied to the address electrodes in order to avoid discharges across the address electrodes and the X electrodes.

In the above mentioned driving method, called a "addressing/sustaining discharge separated writing addressing method", the brightness of the panel depends on the length of the sustaining period, that is, the number of sustaining pluses applied during this period. Since the period of one sustaining pulse does not change throughout all the subframes, the number of sustaining pulses in the respective subframes shown in FIG. 1 comes into a ratio of 1n:2n:4n:8n:16n:32n:64n:128n, wherein n means an integer determined by the sustaining pulse frequency. Accordingly, the brightness of the panel can be controlled within a grey scale between 0 and 256 in this case by selecting and combining subframes to lighten according to a grey scale to be displayed.

Since the combination of the sustaining pulses are provided usually in a ROM table, it is possible to select one particular combination of the sustaining pulses in each subframe from the ROM table based on a desired brightness.

FIG. 3 is a schematic figure of a ROM table. In the example shown, four subframes are provided and 128 combinations of sustaining pulses are provided from addresses SUS0 to SUS127, in order to simplify the explanation. Accordingly, by selecting a suitable ROM address based on a desired brightness, the number of sustaining pulses in the respective subframes is determined, thus allowing a panel display with the desired brightness.

For example, when ROM address SUS0 is selected in FIG. 3, the number of sustaining pulses in subframe SF1 is one, that of in subframe SF2 is two, that of in subframe SF3 four, and that of in subframe SF4 eight. Therefore, the total number of sustaining pulses contained in one frame is fifteen. On the other hand, when selecting ROM address SUS 127, SF1 has 16 sustaining pulses, SF2 32 sustaining pulses, SF3 64 sustaining pulses and SF4 128 sustaining pulses, thus resulting in 240 sustaining pulses in total contained in one frame. Accordingly, a 16 times difference in brightness, that is, the ratio of 15 to 240, can be obtained.

In the respective subframes, the sustaining periods have different lengths to each other while each reset period has the same length and so do the address periods. In addition, as shown in FIG. 1, a quiescent period, in which no driving waveform is output, is provided after the last subframe in each frame.

The above-mentioned driving method of the subframe mode is quite fundamental, and therefore, various changes are made to produce a real plasma display device. In the subframes shown in FIG. 1, for example, the number of sustaining pulses in each subframe is changed at a constant ratio to obtain a constant grey scale display. However, it is possible to set the number of sustaining pulses in high order subframes, for example, in subframes SF6, SF7 and SF8, to the same number as each other in order to saturate the brightness. It is emphasized that the selection of the total number of sustaining pulses is not restricted to a constant ratio and different numbers among subframes may be used.

As explained above, a conventional plasma display device controls its grey scale display by selecting the number of sustaining pulses applied during a sustaining discharge period. On the other hand, the plasma display device is connected with an external device, such as a TV tuner, a video tape deck and a personal computer to display image signals sent from such a device. In this case, various synchronizing signals are sent along with the image signals from the external device. In general, the frequency of the synchronizing signals differs depending on the kind of external devices. Since the length of one frame in a display panel is determined based on the frequency of the synchronizing signals, a phenomenon arises that the frame length changes depending on a device to which a plasma display device is connected.

This causes the following disadvantage. In a case where the frame length becomes shorter than that assumed previously, one driving period of the PDP (reset period+address period+sustaining period, as shown in FIG. 1) exceeds the one frame length, thus resulting in an extraordinary display.

The reset period and the address period are fixed to constant values respectively which are set to be as short as possible. On the other hand, the sustaining period varies depending on the number of sustaining pulses and the period of one sustaining pulse. In case where the ROM table shown in FIG. 3 is used, the maximum values of the sustaining period in the respective subframes are 16T μsec. for subframe F1, 32T μsec. for F2, 64T μsec. for F3 and 128T μsec. for F4, where T means a period of one sustaining pulse.

Accordingly, one driving period α in this case is given as follows:

[(one reset period+one address period)×number of subframes]+[16T μsec.+32T μsec.+64T μsec.+128 μsec.].

One frame length which is required to conduct an ordinary display should exceed the value α (exactly, α+(one vertical fly-back period)). In case that one driving period a exceeds one frame length, an ordinary display is no longer conducted.

On the contrary, when one frame length becomes much shorter than the length of one driving period due to the frequency change in a synchronizing signal externally input, the quiescent period becomes unnecessary longer, thus reducing the brightness.

As mentioned above, the conventional plasma display device driven in a subframe mode does not have enough applicability to various kind of external devices which are driven based on different synchronizing signals.

Figure 4:
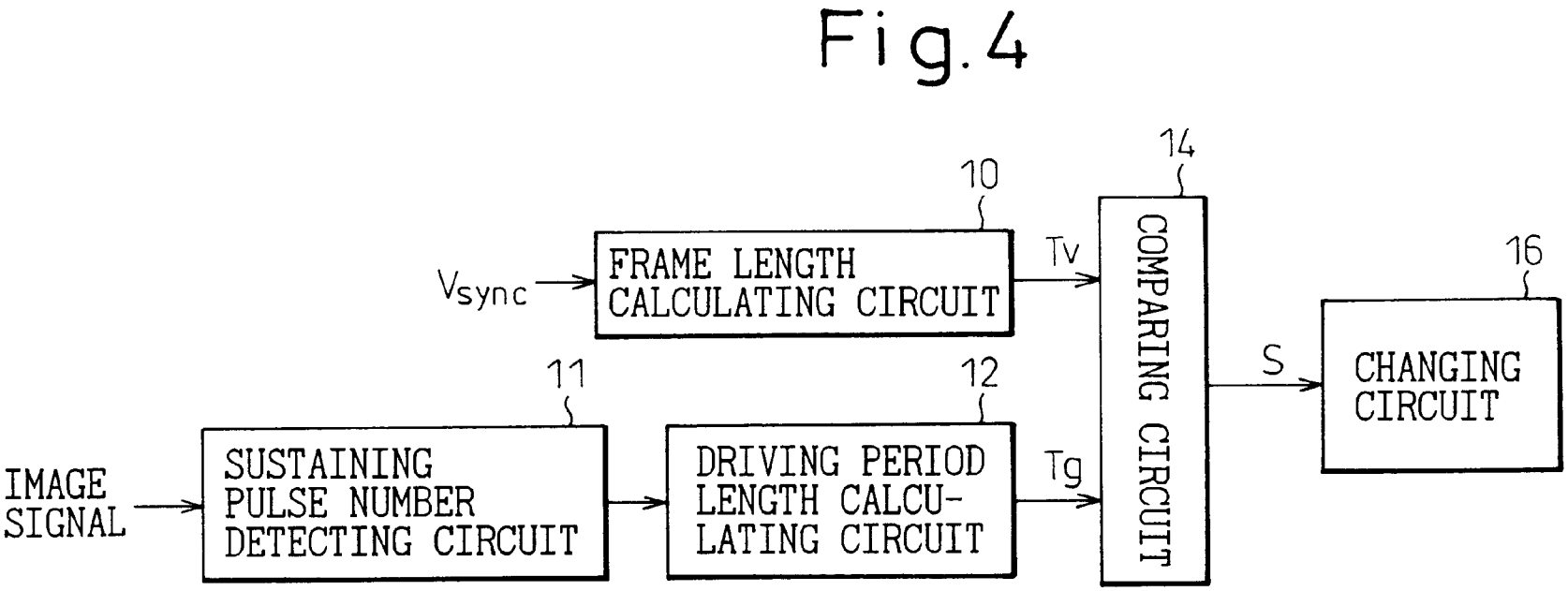
FIG. 4 is a view for explaining a principle structure of the present invention.

FIG. 4 shows the fundamental structure for realizing a function to cope with the frame length change in an external input signal according to the present invention.

In this figure, 10 denotes a frame length calculating circuit for calculating one frame length Tv based on one period of a vertical synchronizing signal Vsync which is input from an external device, 11 a sustaining pulse number detecting circuit for detecting the total number of sustaining pulses contained in one frame according to brightness information contained in an image signal from the external device, and 12 a driving period length calculating circuit for calculating a real driving period length Tg based on the total number of sustaining pulses in one frame, the number of which is detected by the sustaining pulse number detecting circuit 11. The length of Tg of one driving period can be calculated according to the following formula:

[(one reset period+one addressing period)×number of subframes]+[total number of sustaining pulses×T]

wherein T means the pulse width of one sustaining pulse. As is clear from this formula, [(one reset period+one addressing period)×number of subframes] is a fixed values and the pulse width of a sustaining pulse is also fixed. As a result, the driving period length depends only on the number of sustaining pulses.

In FIG. 4, 14 denotes comparing circuit to compare the calculated frame length Tv with the calculated length Tg of one driving period, and outputs a compared signal S. 16 denotes changing circuit for changing the number of total sustaining pulses on one frame or the number of scan lines. According to the first embodiment of the present invention mentioned later, changing circuit 16 reduces the total number of sustaining pulses contained in one frame in order to reduce the driving period length Tg to less than the frame length Tv if comparing circuit 14 finds Tv<Tg. Although this embodiment decreases the brightness of a PDP a little, an extraordinary display of the PDP is effectively avoided. When Tv>Tg, on the contrary, the total number of sustaining pulses in one frame is increased to increase the brightness of the PDP.

In another embodiment of the present invention, changing circuit 16 decreases the number of display lines (scan lines) to shorten the length Tg of one driving period until Tg becomes shorter than Tv. On the contrary, when Tv>Tg, the number of display lines is increased. In a usual PDP, display cells are arranged in a matrix form, and each cell is scanned line sequentially. Therefore, the reduction of the number of scan lines results irn the reduction of the length of an addressing period. For example, by interrupting the drive of some display lines, which are in upper and/or lower parts of the panel, to reduce the number of display lines, respective addressing periods in each subframe are equally shortened, thus the length Tg of one driving period is reduced. As a result, Tg becomes shorter than Tv, to avoid an extraordinary display on the PDP.

On the contrary, when comparing circuit 14 finds that Tv is larger than Tg, e.g., Tv>Tg, one can increase the number of display lines to increase the length of an addressing period uniformly in each subframe. Thus, the number of display lines can be increased to maximize the number as long as Tv is larger than Tg.

In still another embodiment, it is possible that changing circuit changes both the total number of sustaining pulses and the number of display lines to control the relationship between the frame length Tv and the length Tg of one driving period.

Figure 5A:
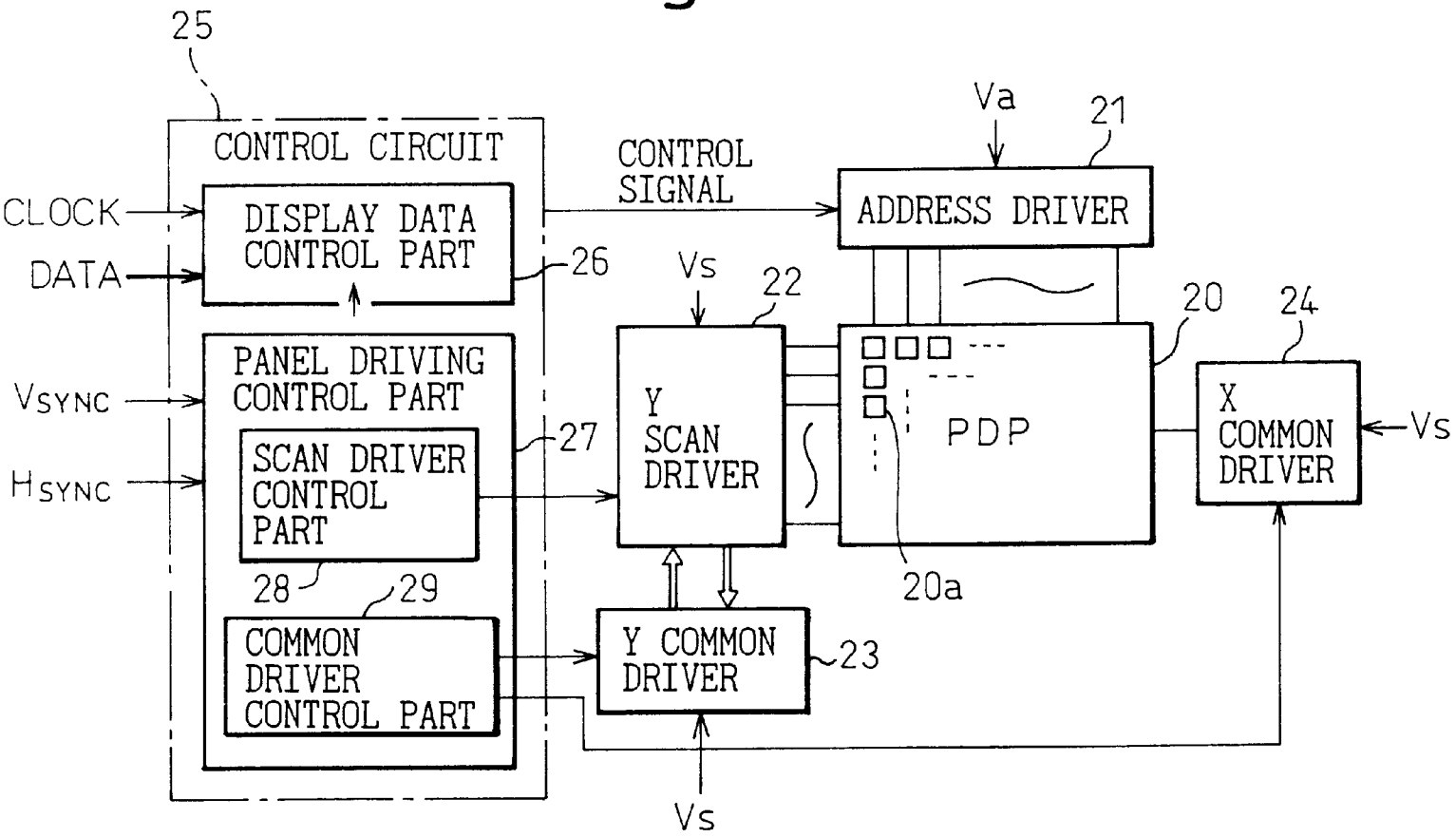
FIG. 5(*a*) is a view showing the entire structure of a plasma display device according to one embodiment of the present invention.
Figure 6:
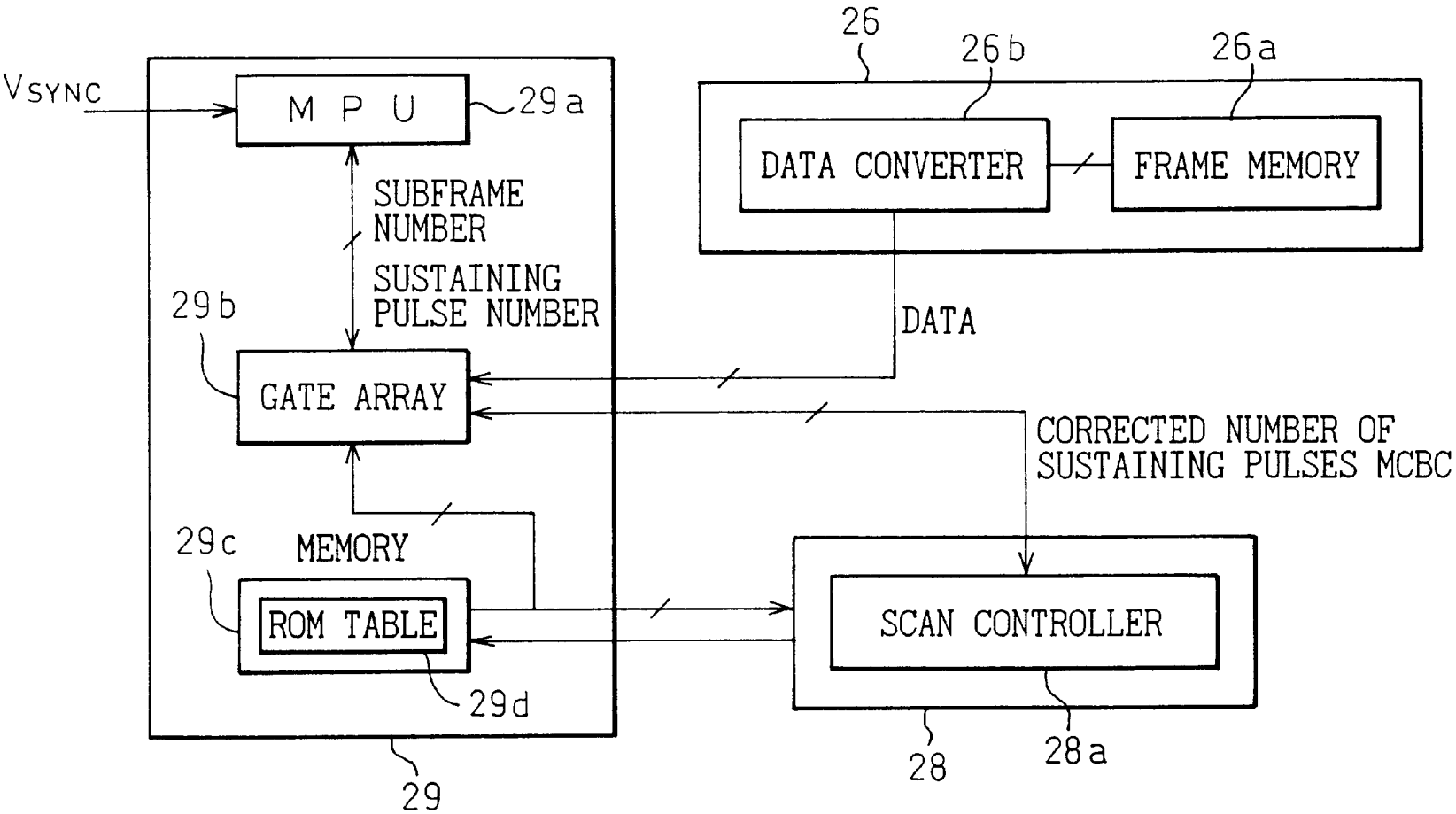
FIG. 6 is a view showing the detailed structure of a part of the plasma display device shown in FIGS. 5(*a*) and 5*b;*

FIG. 5*a* is a block diagram showing the outline structure of a plasma display device for realizing the respective embodiments of the present invention, and FIG. 6 shows a detailed structure of a part of the display shown in FIG. 5*a*. In these figures, 20 denotes a PDP having a plurality of plasma cells 20*a* (light emitting cells) arranged in form of a matrix, 21 an address driver, 22 a Y scan driver, 23 a Y common driver, 24 an X common driver and 25 a control circuit for controlling these drivers.

Control circuit 25 is comprised of a display data control part 26 and a panel drive control part 27. As shown in FIG. 6, the display data control part 26 has a frame memory 26*a*, which temporally stores image data (DATA) from an external device and a data converter 26*b*, which gives a predetermined signal processing and timing processing to the data stored in frame memory 26*a* and outputs the resulting data to address driver 21. The panel drive control part 27 includes a scan driver control part 28 and a common driver control part 29 and generates various timing signals based on vertical synchronizing signals Vsync supplied from the external device. The generated timing signals are supplied to the display data control part 26, the Y scan driver 22, the Y common driver 23 and the X common driver 24.

Figure 5B:
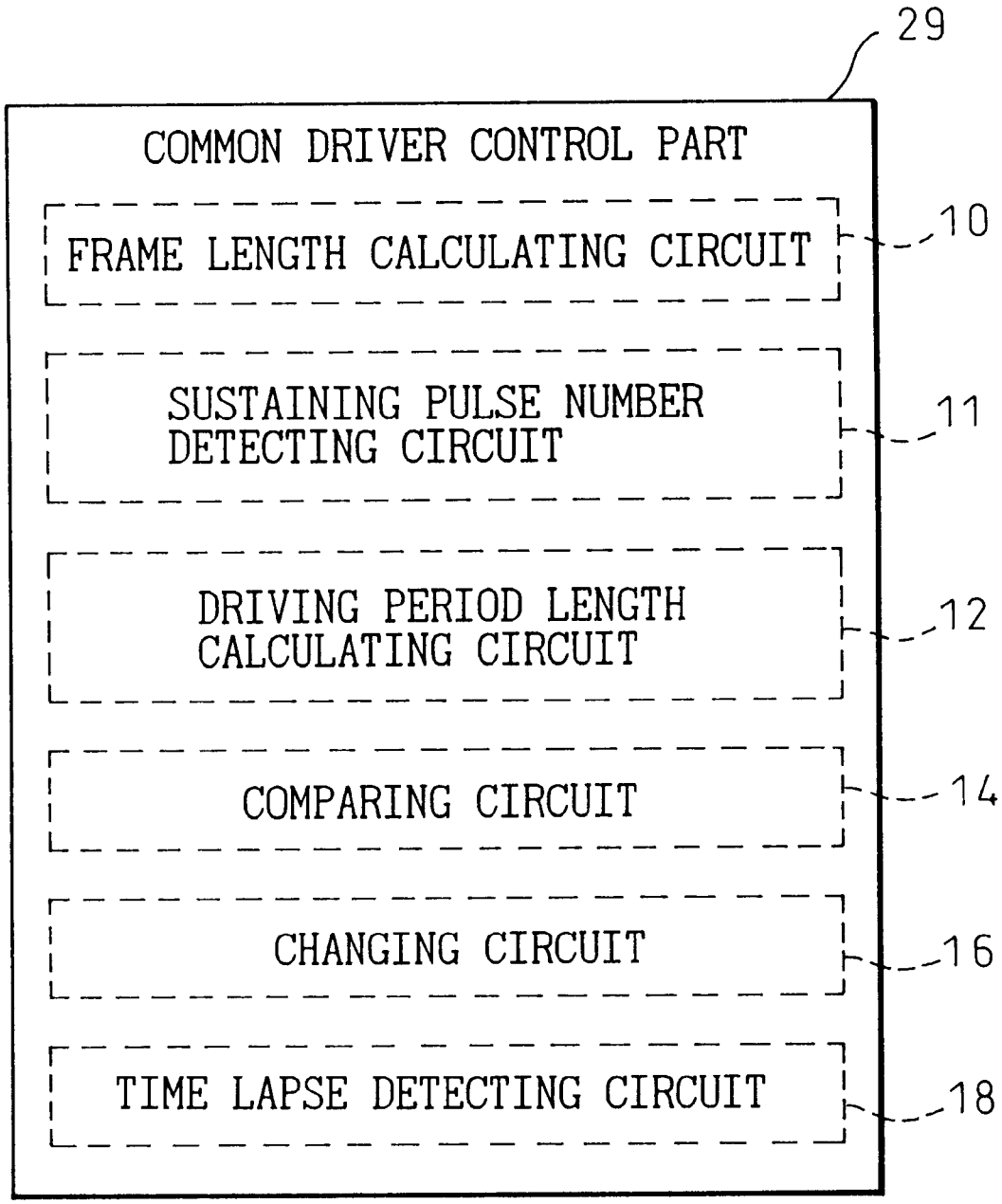

In one embodiment of the plasma display device according to the present invention, the common driver control part 29 contains the frame length calculating circuit 10, the sustaining pulse number detecting circuit 11, the driving period length calculating circuit 12, the comparing circuit 14 and the changing circuit 16, as shown in FIG. 5*b*. These circuits are usually formed with a microprocessor unit 29*a* and a memory 29*c* in which a program for making the microprocessor unit 29*a* function as these circuits is stored, as shown in FIG. 6.

It is further indicated in FIG. 5*b* that the common driver control part 29 contains a time lapse detecting circuit 18 which is also realized by the microprocessor unit and the program and whose function will be explained later.

Address driver 21 generates address pulses using a high voltage supply Va for selecting display cells and selectively applies these pulses to address electrodes of panel 20. Y scan driver 22 generates scan pulses using a high voltage supply Vs, which is for sustaining a display, and applies these scan pulses line sequentially to Y electrodes of panel 20. These address pulses and scan pulses are generated during the addressing period in each subframe.

Y common driver 23 generates sustaining pulses using a high voltage supply Vs for sustaining display, and applies these sustaining pulses to all the Y electrodes of panel 20 simultaneously. In a similar manner, the X common driver 24 generates sustaining pulses and a full-screen writing pulse using the high voltage supply Vs for sustaining display. The full-screen writing pulses are applied to all the X electrodes of panel 20 simultaneously during the reset period of each subframe. Of course, the sustaining pulses are applied to all the X electrodes simultaneously during the sustaining discharge period in each subframe.

FIG. 6 is a block diagram showing a part of the plasma display device shown in FIG. 5*a*, the part which is essential for realizing the function shown in FIG. 4. As previously mentioned, the common driver control part 29 includes microprocessor unit (referred to as MPU, below) 29*a*, a gate array 29*b* and memory 29*c* in which a ROM table 29*d* for storing combinations of sustaining pulses is further included. In FIG. 7, an example of a ROM table 29*d* is shown for driving 8 subframes in one frame. As shown in FIG. 6, scan driver control part 28 is comprised of a scan controller 28*a*.

The operation of the device shown in FIGS. 5 and 6 will be explained below with respect to the function to realize the objects of the present invention.

Image data (display data, DATA) introduced from an external device, for example, a TV, are stored first in frame memory 26*a* and converted into digital data in data converter 26*b*, which digital data are then sent to the common driver control part 29. MPU 29*a* in the common driver control part 29 calculates the actual length Tg of one driving period based on the data from data converter 26*b*. In actuality, MPU 29*a* finds brightness information from the data sent from data converter 26*a* and then finds the total number of sustaining pulses in one frame by referring to ROM table 29*d* which contains information regarding the number of subframes and the number of sustaining pulses in the respective subframes.

On the other hand, MPU 29*a* calculates one frame length Tv according to vertical synchronizing signals Vsync from the external device. The calculated values Tg and Tv are compared also in MPU 29*c* to determine the correction value of the total number of sustaining pulses or the number of scan lines. Then, the correction value is sent to scan controller 28*a*, which controls the driving period length Tg by increasing or decreasing the number of scan lines or the address of ROM table 29*d*.

Next, the various embodiment of the device shown in FIGS. 5 and 6 will be explained with referring to flowcharts, each of which shows a program condition in MPU 29*a*. Therefore, by changing a program in MPU 29*c*, various embodiments of the present invention can be realized.

In explaining the various embodiments, the ROM table shown in FIG. 7 will be referred to. The ROM table shown is used in a PDP driven in a subframe mode and having an automatic power control function, for determining the upper limit value of the brightness (that is, the total number of sustaining pulses). In a conventional PDP, when selecting, for example, SUS 127 in the ROM table shown in FIG. 3, not only the brightness but the power consumption becomes a maximum (in a case where the display ratio is equal to 100%). Since the display ratio is usually about 30%, the power consumption of the PDP does not exceed a designed value even if SUS 127 is selected. However, when the display ratio unusually comes to about 100% or near to 100%, the power consumption may exceed the designed value. Therefore, the automatic power control function restricts the selection of addresses of the ROM table so as not to exceed a designed maximum value of brightness (referred to as MCBC, below). The ROM table shown in FIG. 7 indicates these maximum values of brightness. However, the ROM table of FIG. 7 is shown only as an example, and therefore, the present invention is not restricted to the ROM table used for such a special purpose.

The First Embodiment

Figure 8:
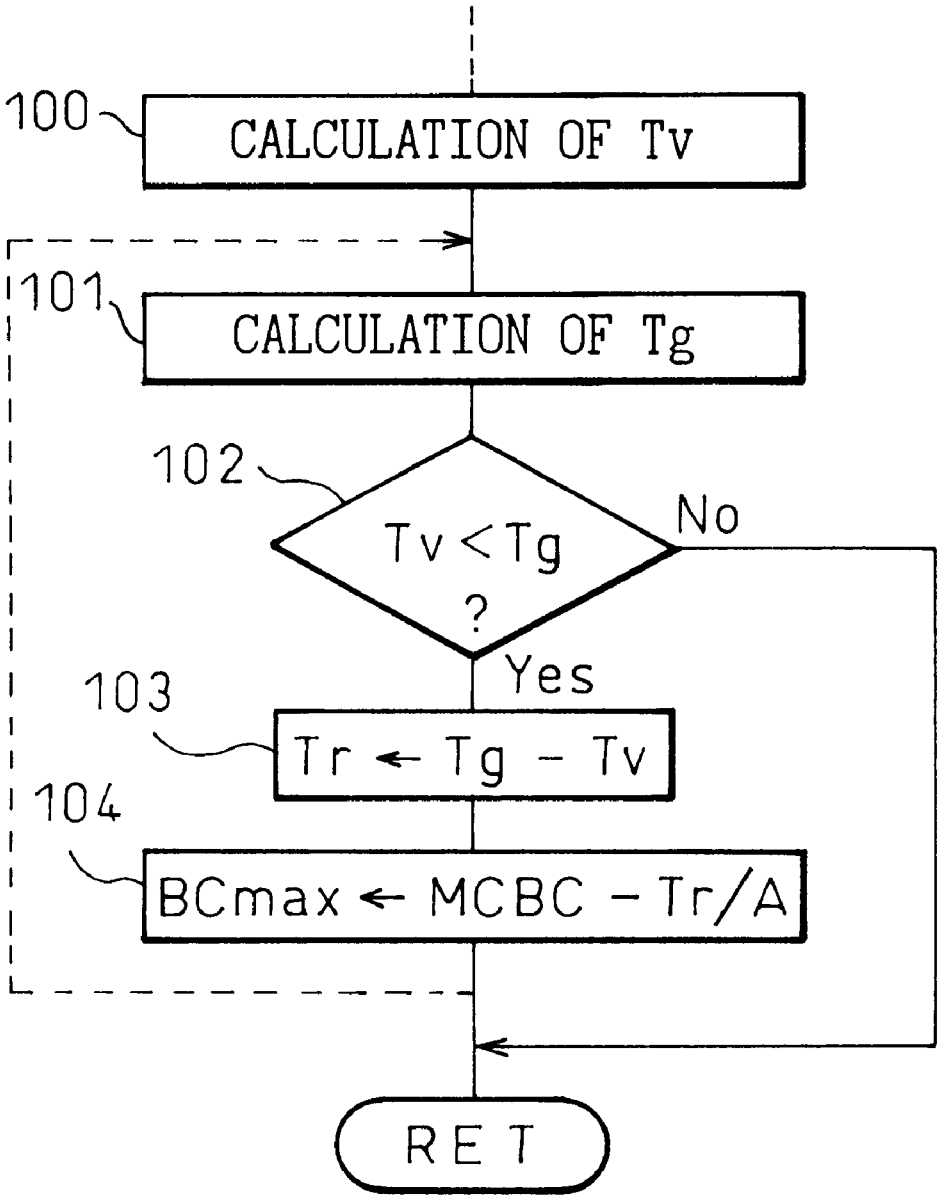
FIG. 8 is a view showing a flowchart according to the first embodiment of the present invention.

The flowchart shown in FIG. 8 indicates processes to avoid an extraordinary display, which happens when one frame length derived from an input signal is shorter than one driving length of a PDP, by decreasing the total number of sustaining pulses in one frame.

First, the length of one period of vertical synchronizing signal Vsync is measured at step 100, and the measured value is set to be one frame length Tv for driving the PDP. Thereafter, at step 101, the length of one driving period Tg is calculated as follows. First, the length of one reset period is added to that of one addressing period and the resulting value is multiplied by the number of subframes in one frame. In this case, the respective lengths of reset periods and addressing periods are fixed to the same values respectively over the entire subframes. Second, the total number of sustaining pulses is obtained from a ROM table address which corresponds to the brightness of the input image signal. For example, when the brightness of the input image signal corresponds to address MCBC 126 shown in FIG. 7, the total number of sustaining pulses is obtained as 377 from the table. Based on this value, the total length of sustaining discharge periods in one frame can be calculated, which is then added with the total length of the reset periods and the addressing periods obtained as mentioned before, in order to derive the length of one driving period Tg.

In the next step 102, the frame length Tv obtained at step 100 is compared with the length Tg of one driving period obtained at step 101. When Tv is less than Tg, the difference Tr (=Tg−Tv) is obtained at step 103. Thereafter, at step 104, Tr is divided by constant A, which is adequately determined in advance, to find a magnitude of reduction of the address value. The present address, for example, address MCBC 126, is thus decreased by the amount of Tr/A to obtain a corrected address BCmax, for example, address MCBC 124.

By selecting an adequate value to be the constant A, the address of the ROM table can be decreased sufficiently, and as a result, the total number of sustaining pulses can be decreased sufficiently to shorten the length Tg of one driving period to less than the one frame length Tv, thus avoiding an extraordinary display. For example, the address reduction from MCBC 126 to MCBC 124 results in the reduction of the total number of sustaining pulses in one frame from 377 to 369, thus shortening the driving period Tg to less than the frame length Tv. On the other hand, when Tv is larger than Tg at step 102, the present address MCBC is used without any address reduction.

If a relatively large value is selected as constant A, the address value of the ROM table may not be reduced sufficiently to shorten the driving period length Tg less than the frame length Tv. On the other hand, if a relatively small value is selected as constant A, such an inconvenience can be avoided. In this case, however, a large address change occurs in the ROM table, thus inviting an undesirable condition in which the brightness change on the PDP is too great.

In order to avoid the above inconvenience, constant A may be selected to be as large as possible and the output from step 104 may be connected not to RETURN but to the input of step 101, as shown with a dotted line in FIG. 8. In other words, the calculation of the driving period length Tg and the comparison between Tv and Tg are repeated by reducing an address value of the ROM table in short steps, thus making it possible to detect an adequate address of the ROM table without inviting a large brightness change.

Second Embodiment

Figure 9:
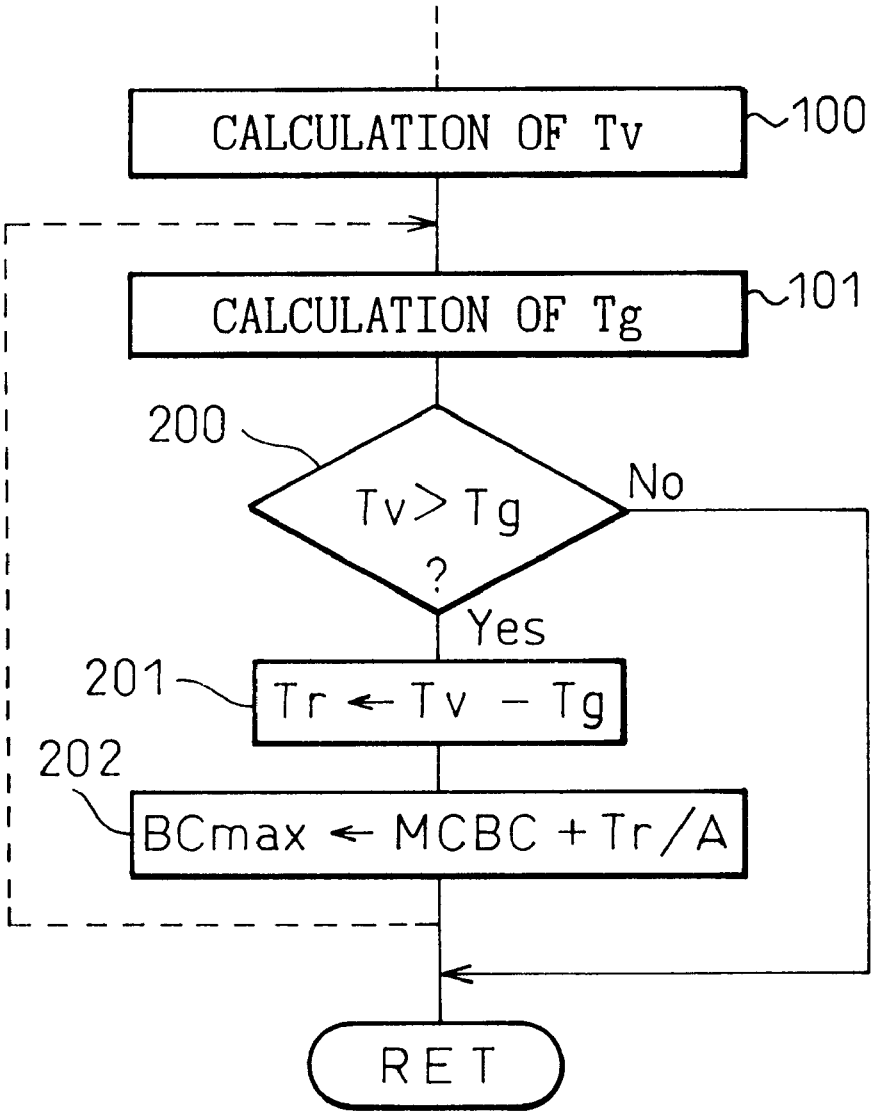
FIG. 9 is a view showing a flowchart according to the second embodiment of the present invention.

The flowchart shown in FIG. 9 shows processes to increase the brightness of a PDP by increasing the total number of sustaining pulses when a driving period length is shorter than a frame length determined by an input synchronizing signal. In the embodiments shown below, the same reference numerals are adopted to the same or the similar steps, and therefore, the explanation thereof will not be repeated in detail.

At step 100, one frame length Tv is obtained based on one period of an input vertical synchronizing signal Vsync. Next, at step 101, one driving period length Tg is obtained based on an address of the ROM table, which address corresponds to the brightness of the input image signal. For example, when address MCBC 124 is used, it is found from the ROM table that the total number of sustaining pulses in one frame is 369. The driving period length Tg can be calculated based on the total number of sustaining pulses thus obtained as mentioned in the first embodiment.

Next, at step 200, the comparison between Tg and Tv is conducted to find if Tv>Tg. In case that Tv>Tg, i.e., the frame length determined by an input synchronizing signal is longer than the driving period length, the calculation Tv>Tg is conducted at step 201 to find the difference Tr. At step 202, Tr is divided by an adequately determined constant A, thus obtaining an increasing amount of address step, which is then added to the present address, for example, MCBC 124, to obtain a corrected address BCmax, for example, MCBC 126. As a result, the brightness of the PDP is increased by an amount corresponding to the increase in the total number of sustaining pulses, for example, from 369 to 377. In this case, as explained in the first embodiment, constant A may be set as large as possible and the output of step 202 may be connected to the input of step 101 to repeat the processes from step 101 to step 202. As a result, a value of BCmax as large as possible can be obtained, thus allowing the brightness of the PDP to be set to the highest value within a range in which an ordinary display is possible.

By combining the first embodiment and the second embodiment, another processing is possible as follows. In case that, as a result of the processing shown in FIG. 8, the frame length Tv becomes much longer than the driving period length Tg by lowering the ROM table address, for example, from MCBC 126 to MCBC 122, then, the brightness of the PDP is increased by conducting steps 200 to 202 shown in FIG. 9 to increase the ROM table address, for example, up to MCBC 125. Thus, the brightness can be increased to a maximum value as long as the ordinary display is possible.

Third Embodiment

The first and the second embodiments assume that the frequency of an input synchronizing signal does not change during the whole display process. However, in a video tape recorder, for example, the frequency (60 Hz) in an ordinary playback mode is different from that (61.5 Hz) of a quick playback mode. In addition, these modes are used repeatedly in general. In such a case, when the driving mode is changed from the ordinary playback mode to the quick playback mode, the frame length Tv becomes shorter than before.

Therefore, the total number of sustaining pulses should be reduced immediately according to the process shown in FIG. 8 to avoid an extraordinary display. However, as mentioned before, the quick playback mode and the ordinary playback mode are used repeatedly. Therefore, if the total number of sustaining pluses is increased to raise the brightness of the PDP when the driving mode is temporarily set back from the quick playback mode to the ordinary playback mode, it should be decreased again after a short period to reduce the brightness at the next quick playback mode. This yields a disadvantage that the brightness of the PDP changes too frequently.

The present embodiment avoids such a disadvantage by not increasing the total number of sustaining pulses to increase the brightness of the PDP during a temporally return from the quick playback mode to the ordinary playback mode, but by increasing the total number of sustaining pulses to increase the brightness after the driving mode completely returns to the ordinary playback mode.

Figure 10:
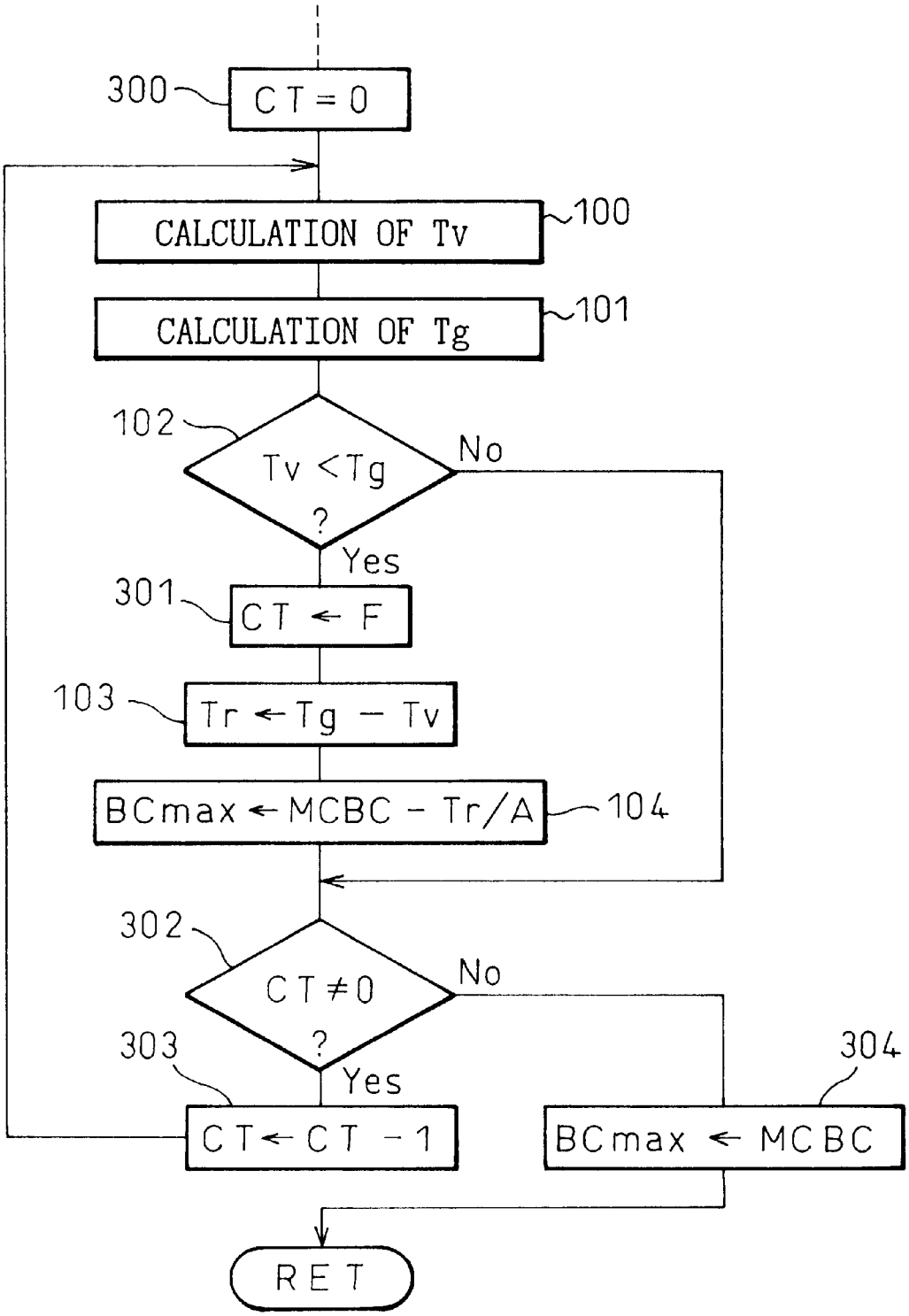
FIG. 10 is a view showing a flowchart according to the third embodiment of the present invention.

To this end, the present embodiment adds the following steps to the flowchart shown in FIG. 8 as shown in FIG. 10: step 300 for resetting counter CT to 0; step 301 for setting the value of counter CT to a predetermined value F after completing the comparison between Tv and Tg; step 302 for Judging the counter CT value to be 0 or not, after completing the brightness correction in step 104; step 303 for reducing the value in counter CT by one; and step 304 for resetting the brightness value BCmax to the original value MCBC when the value of counter CT becomes 0 at step 302. In one embodiment of the present invention, these functions are realized by the time lapse detecting circuit 18 in the common driver control part 29 shown in FIG. 5*b*.

According to the flowchart shown in FIG. 10, when the frame length of an input signal changes, for example, from 60 Hz to 61.5 Hz due to an operation change from the ordinary playback mode to the quick playback mode, the total number of sustaining pulses is reduced immediately to conduct the ordinary display by implementing steps 100 to 103. In case that the driving mode returns temporarily from the quick playback mode to the ordinary playback mode and Tv≧Tg at step 102, re-correction of the brightness is not conducted until counter CT counts F from 0. In other words, the brightness is maintained at BCmax, which is of the brightness during the quick playback mode. Once a predetermined time (determined by F) has passed while keeping the ordinary playback mode, this state is no longer deemed as a temporarily return from the quick playback mode to the ordinary playback mode. Therefore, at step 304, the brightness of the panel should be returned from BCmax to the original brightness MCBC, which is of the brightness for the ordinary playback mode. Thus, a frequent change in brightness can be avoided even though the ordinary playback mode and the quick playback mode are repeated.

The embodiments described above overcome the frame length change by changing the total number of sustaining pulses. However, the embodiments described below overcome the frame length change by changing the number of scan lines in the PDP. Changing the number of scan lines results in the uniform change of the addressing periods in the respective subframes, for example, shown in FIG. 1. Accordingly, by reducing the number of scan lines, the length of one driving period becomes shorter while it becomes longer by increasing the number of scan lines.

Fourth Embodiment

Figure 11:
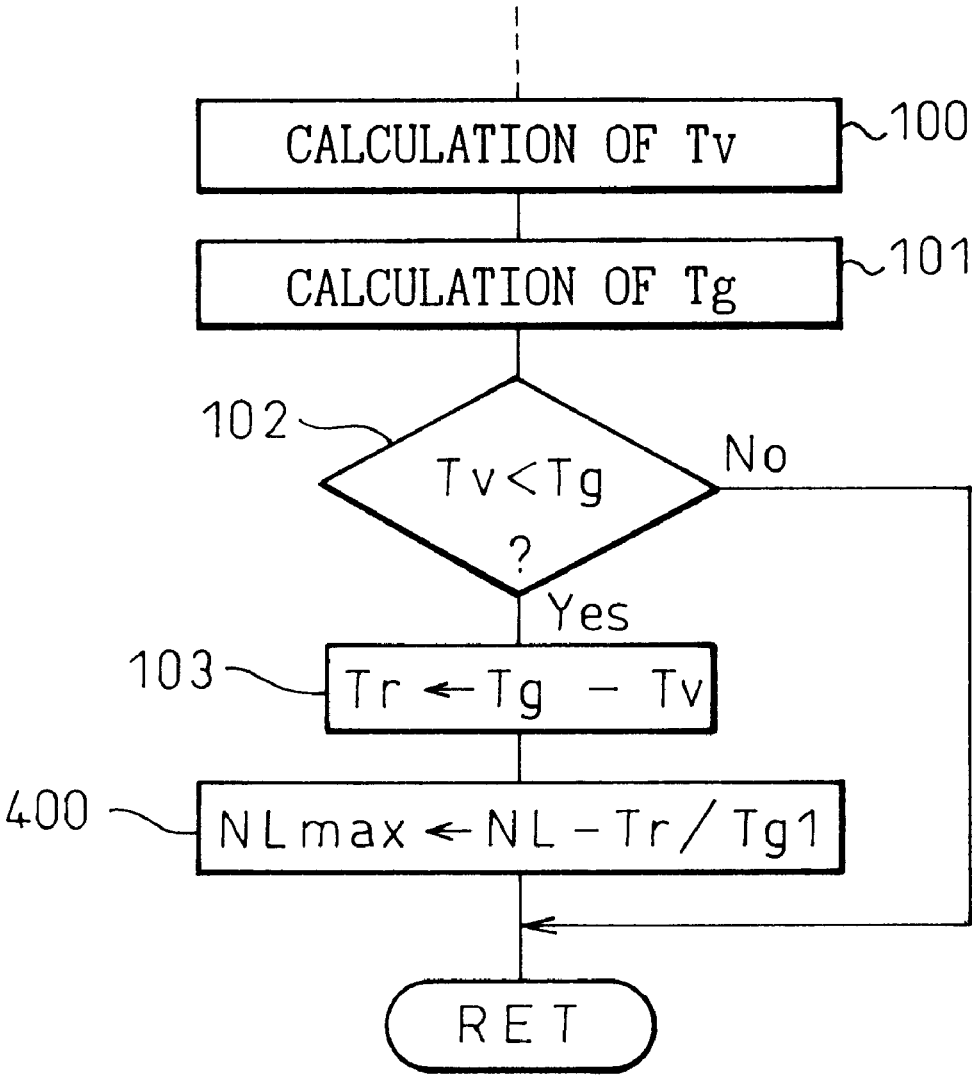
FIG. 11 is a view showing a flowchart according to the fourth embodiment of the present invention.

In the embodiment shown in FIG. 11, Tv and Tg are obtained at steps 100 and 101, Tv and Tg are compared in step 102, and the difference Tr between Tv and Tg is derived in step 103 in the same manner as the first embodiment which changes the total number of sustaining pulses to overcome the frame length change. Thereafter, at step 400, Tr/Tg1 is subtracted from NL, which is the number of scan lines at present, to derive a new number of scan lines NLmax, where Tg1 indicates a driving period for scanning one display line. Thus, the respective addressing periods can be reduced so that the length of one driving period becomes shorter than the one frame length to avoid an extraordinary display.

Fifth Embodiment

Figure 12:
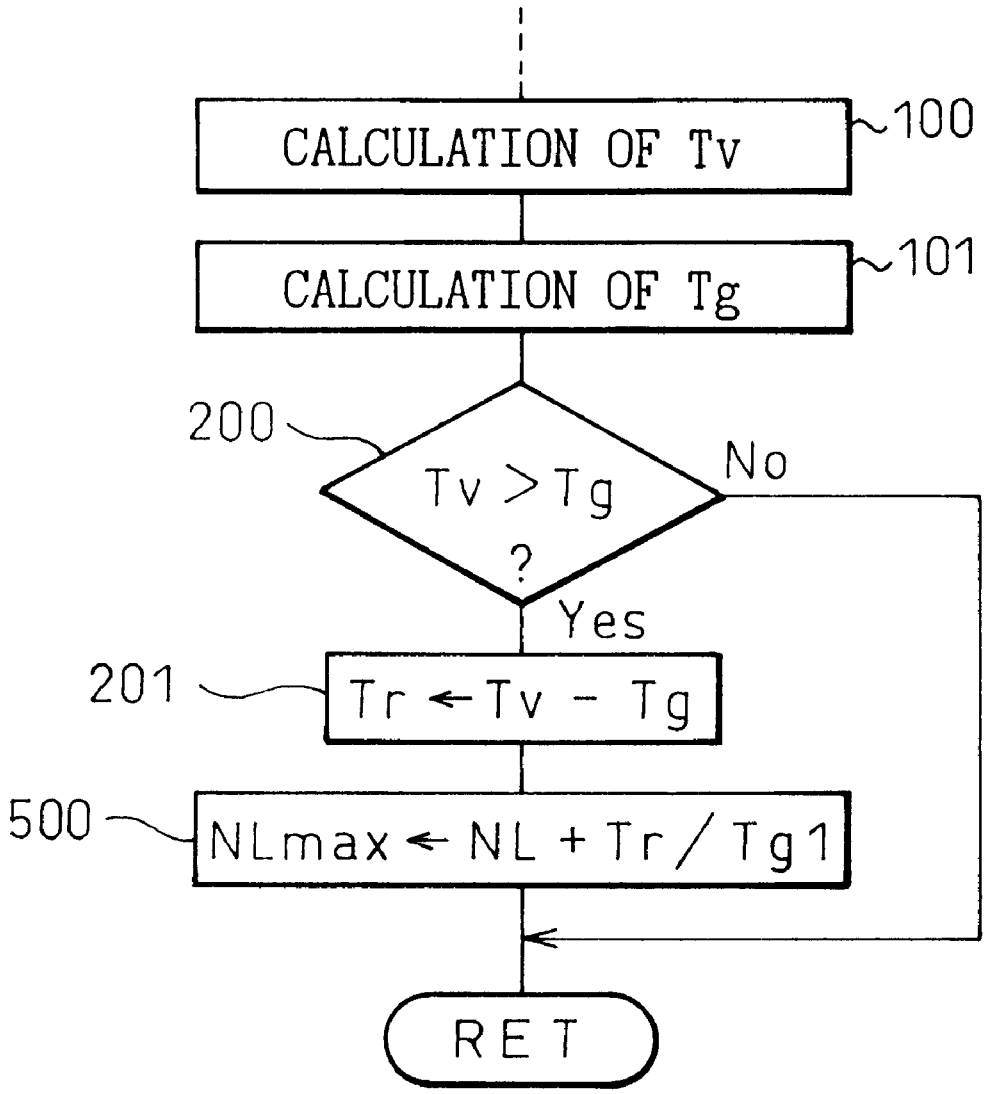
FIG. 12 is a view showing a flowchart according to the fifth embodiment of the present invention.

In the embodiment shown in FIG. 12, if Tv is found to be longer than Tg at step 200, then, the calculation of (Tv−Tg) is conducted at step 201 to derive the difference Tr. Thereafter, at step 500, Tr is divided by Tg1, which is of one driving period for one scan line, and the quotient Tr/Tg1 is added to the present number of scan lines to derive a corrected number of scan lines NLmax. Thus, the number of scan lines is increased to a maximum value as long as the condition Tv>Tg is maintained.

Sixth Embodiment

Figure 13:
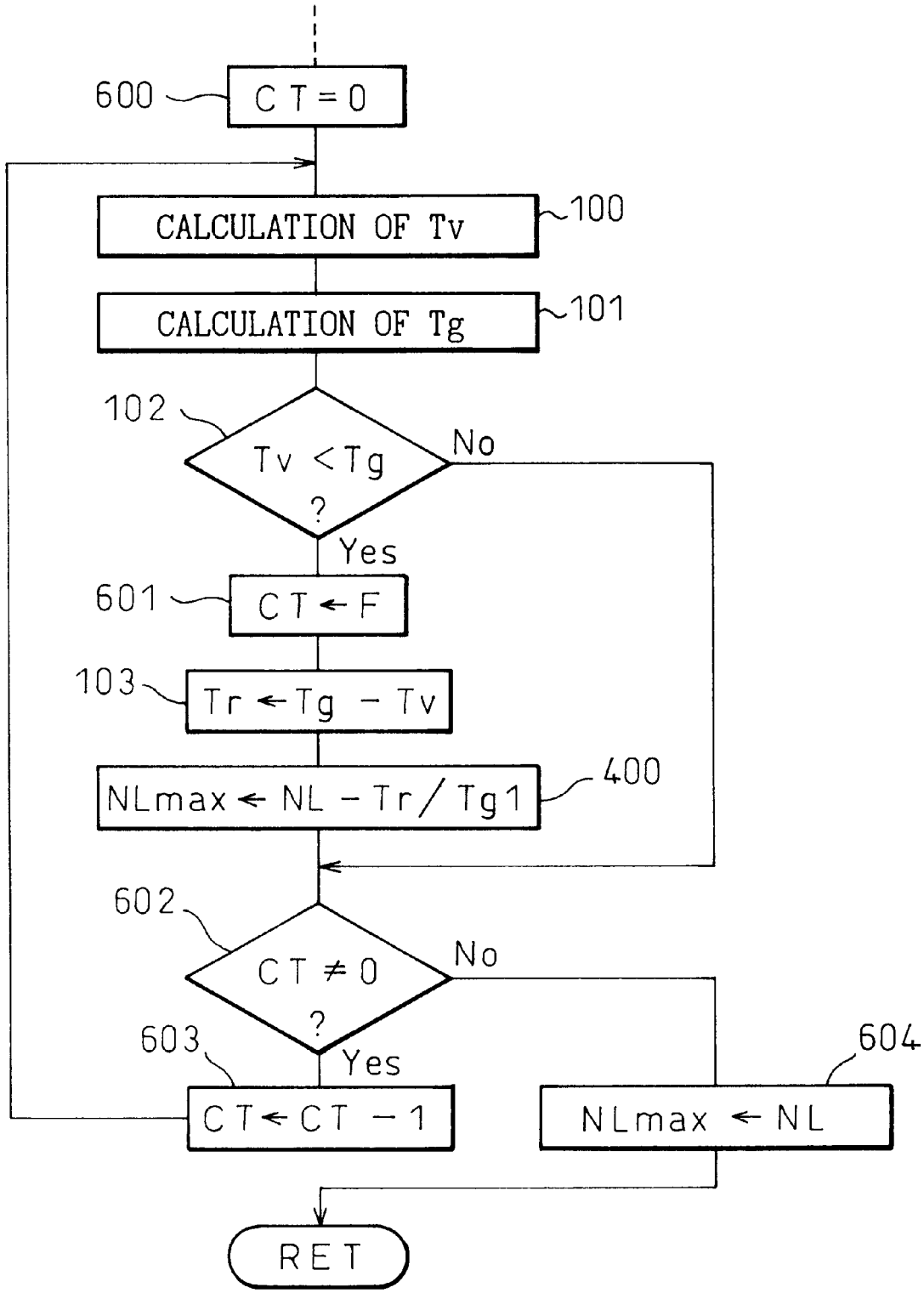
FIG. 13 is a view showing a flowchart according to the sixth embodiment of the present invention.

The flowchart shown in FIG. 13 has an additional function, which is able to avoid a frequent brightness change derived from a temporarily frequency changes of an input signal, in addition to the function of the fourth embodiment shown in FIG. 11, which overcomes the extraordinary display problem by reducing the number of scan lines. This function is based on the same necessity as that of the third embodiment, and therefore, the explanation thereof will not be repeated here.

In this embodiment, new steps 600, 601, 602, 603 and 604 are added to the flowchart of embodiment 4 shown in FIG. 11, wherein step 600 is to reset counter CT to 0, step 601 to set counter CT to be a predetermined value F, step 602 to judge whether counter CT is 0 or not, step 603 to decrement counter CT by one, and step 604 to reset the corrected number of scan lines NLmax, obtained by conducting steps 100 to 103 and 400, to the original number of scan lines NL.

The detailed explanation of embodiment 6 is not described here because the processes of this embodiment are the same or similar to those of the third embodiment except that the reduction of the total number of sustaining pulses in the third embodiment is replaced by the reduction of the number of display lines.

The fourth to the sixth embodiments mentioned above are also effective as a supplemental technique for the existing countermeasures against a multi-scanning mode. For example, among PDPs driven in a subframe mode, there is proposed a PDP having a multi-Vsync function which is to reduce the number of subframes in synchronizing with the period of a vertical synchronizing signal (Vsync). This function can, however, adjust the length of a driving period using only the minimum subframe, for example, SF1, as one unit, thus resulting in a rough adjustment. On the contrary, a fine adjustment is possible by applying the present embodiment. This provides a PDP having a high applicability to a wide range of frequency, in addition to the effect of reducing the number of the subframes.

Seventh Embodiment

Figure 14A:
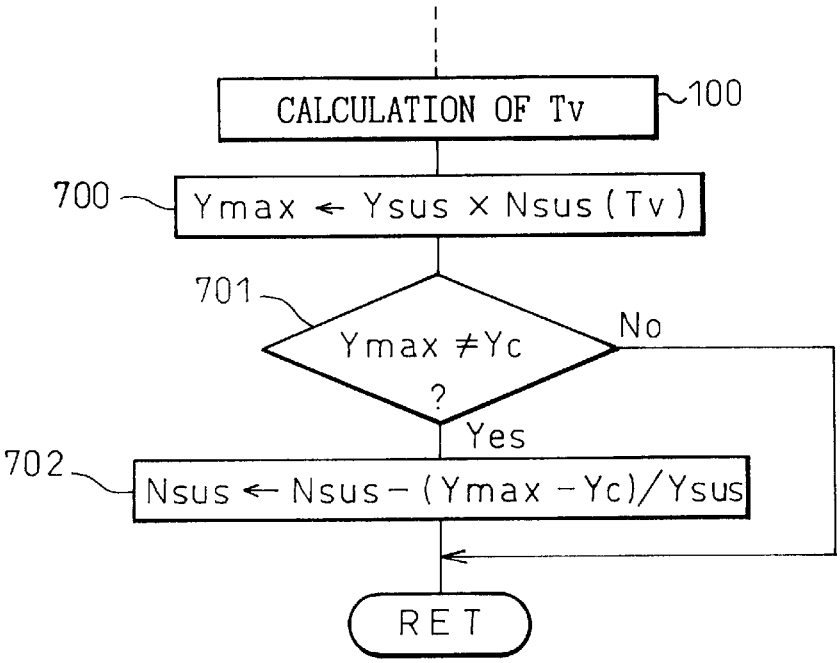
FIG. 14(*a*) is a view showing a flowchart according to the seventh embodiment of the present invention.

In the first and the second embodiments mentioned above, the display brightness of a PDP changes according to the frequency change of an input signal from an external device, to which the PDP is connected. As a result, an event occurs in which one image is displayed with a different brightness when a PDP is connected to a different external device, although the image essentially has the same brightness. The flowchart shown in FIG. 14*a* shows the seventh embodiment of the present invention to cope with such an event.

In this embodiment, one frame length Tv is first calculated from one period of an input synchronizing signal at step 100. Thereafter, at step 700, the maximum number of sustaining pulses Nsus(Tv), which can be applied during the one frame length Tv without causing an extraordinary display, is calculated based on the frame length Tv obtained in step 100. By multiplying Ysus, which is of a brightness of one sustaining pulse, by Nsus(Tv), the maximum brightness Ymax which can be displayed without causing any extraordinary display is obtained. On the other hand, a brightness to be a reference value (predetermined brightness Yc) has been set in advance in order to fix the display brightness constant without depending on the frequencies of input signals.

At step 701, the obtained maximum brightness Ymax and the predetermined brightness Yc are compared. In a case where the values do not agree with each other at step 701, the process moves to step 702 in which correction of the present number of sustaining pulses is conducted to make it agree with the predetermined brightness Yc. In actuality, the predetermined brightness Yc is subtracted from the maximum brightness Ymax and the difference is divided by brightness Ysus for one sustaining pulse, thus obtaining a correction value of the total number of sustaining pulses. Then, this correction value is subtracted from Nsus, which is the number of sustaining pulses capable of being displayed, and as a result, the number of sustaining pulses corresponding to the predetermined brightness Yc is obtained.

Figure 14B:
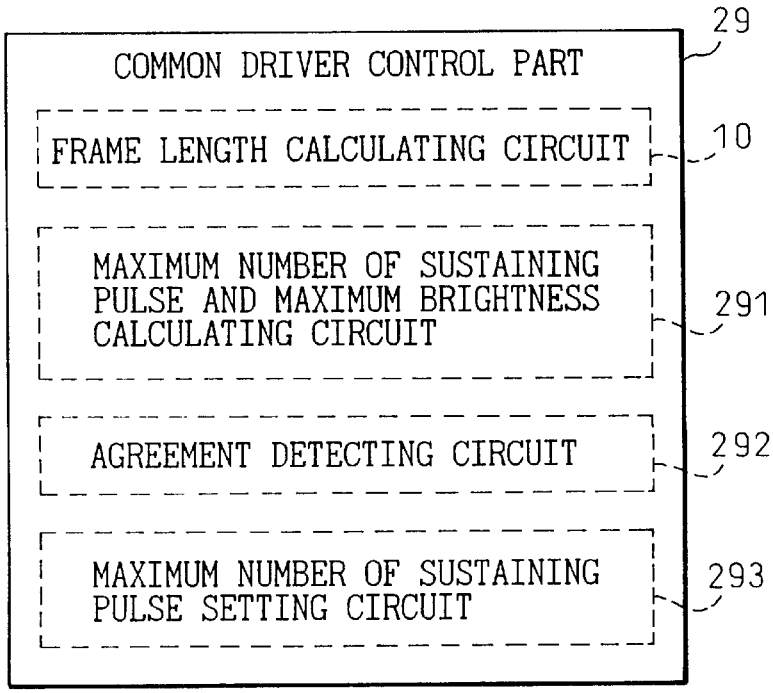

FIG. 14*b* shows the structure of the common driver control part 29 shown in FIG. 5*a*, which structure is designed especially to realize the seventh embodiment. In fact, common driver control part 29 includes the frame length calculating circuit 10 for conducting the step 100, a maximum number of sustaining pulse and maximum brightness calculating circuit 291 for conducting the step 700, an agreement detecting circuit 292 for conducting the step 701, and a maximum number of sustaining pulse setting circuit 293 for conducting the step 702 shown in FIG. 14*a*. These circuits 10, 291, 292, 293 and 294 are, of cause, structured with the MPU 29*a* and the memory 29*c* shown in FIG. 6.

Accordingly, the present invention is capable of improving the display quality of a PDP by so adjusting the total number of sustaining pulses that an image is displayed with the same brightness regardless that what kind of external device is connected to the PDP.

As described above with reference to the preferred embodiments, the plasma display device according to the present invention is capable of conducting an ordinary display even if it is connected to an external device driven by a different frequency. This is because the plasma display device can adjust the total number of sustaining pulses or the number of scanning lines so that the relationship between the frame length and the driving period length becomes proper. Thus, the present invention provides a plasma display device having a high applicability to a variety of external devices.

What is claimed is:

1. A plasma display device comprising:

a plasma display panel; and a driving part for driving the plasma display panel in a subframe mode in which one frame for display is divided into a plurality of subframes and a predetermined number of sustaining pulses is applied to the plasma display panel during each of the subframes so as to cause a sustaining discharge;

said driving part further comprising, a first circuit for calculating a length of one frame for display according to one period of a vertical synchronizing signal which is input from an external device along with an image signal, a second circuit for detecting a total number of sustaining pulses contained in one frame based on a brightness information contained in said image signal, a third circuit for calculating a length of one driving period of the plasma display panel necessary for displaying one frame based on the total number of sustaining pulses detected by said second circuit, a fourth circuit for comparing respective results from said first circuit and said third circuit, and a fifth circuit for changing a total number of sustaining pulses in one frame according to a compared result in said fourth circuit.

2. The plasma display device according to claim 1, wherein said fifth circuit changes the total number of sustaining pulses in a manner to reduce the same when said fourth circuit finds that the length of one frame obtained by the first circuit is shorter than the length of one driving period obtained by the third circuit.

3. The plasma display device according to claim 1, wherein said fifth circuit changes the total number of sustaining pluses in a manner to increase the same when said fourth circuit finds that the length of one frame obtained by the first circuit is longer than the length of one driving period obtained by the third circuit.

4. The plasma display device according to claim 1, wherein said driving part is further comprised of a sixth circuit for detecting a lapse of a predetermined time period in which no change is detected once said fourth circuit has detected a change in a comparing result, and wherein said fifth circuit changes the total number of sustaining pulses after said sixth circuit detects the lapse of the predetermined time period.

5. The plasma display device according to claim 1, wherein said first circuit, said third circuit and said fourth circuit are comprised of a microprocessor unit and a recording media in which a program for making said microprocessor unit function as said first, third and fourth circuit is stored.

6. A plasma display device comprising:

a plasma display panel; and a driving part for driving the plasma display panel in a subframe mode in which one frame for display is divided into a plurality of subframes and a predetermined number of sustaining pulses is applied to the plasma display panel during each of the subframes so as to cause a sustaining discharge;

said driving part further comprising, a ROM table having a plurality of addresses in which a combination of numbers of sustaining pulses for respective subframes is stored, a first circuit for calculating a length of one frame for display according to one period of a vertical synchronizing signal which is introduced from an external device along with an image signal, a second circuit for detecting a total number of sustaining pulses contained in one frame based on an address of said ROM table, said address which corresponds to brightness information contained in said image signal;

a third circuit for calculating a length of one driving period of the plasma display panel necessary for displaying one frame based on the total number of sustaining pulses detected by said second circuit, a fourth circuit for comparing results from said first circuit and said third circuit; and a fifth circuit for changing an address of the ROM table according to a compared result in said fourth circuit.

7. The plasma display device according to claim 6, wherein said fifth circuit changes an address of the ROM table in a manner to reduce a total number of sustaining pulses contained in the address when said fourth circuit finds that the length of one frame obtained by the first circuit is shorter than the length of one driving period obtained by the third circuit.

8. The plasma display device according to claim 6, wherein said fifth circuit changes an address of the ROM table in a manner to increase a total number of sustaining pulses contained in the address when said fourth circuit finds that the length of one frame obtained by the first circuit is longer than the length of one driving period obtained by the third circuit.

9. The plasma display device according to claim 6, wherein said driving part is further comprised of a sixth circuit for detecting a lapse of a predetermined time period during which no change is detected once said fourth circuit has detected a change in a compared result, and wherein said fifth circuit changes the total number of sustaining pulses after said sixth circuit detects the lapse of the predetermined time period.

10. The plasma display device according to claim 1, wherein said first circuit, said third circuit and said fourth circuit are comprised of a microprocessor unit and a recording media in which a program for making said microprocessor unit function as said first, third and fourth circuits is stored.

11. A plasma display device comprising:

a plasma display panel having a plurality of light emitting cells arranged in form of a matrix; and a driving part for driving the plasma display panel in a subframe mode in which one frame for display is divided into a plurality of subframes and a predetermined number of sustaining pulses is applied to said plurality of light emitting cells in each subframe while scanning the plurality of light emitting cells line-sequentially;

said driving part further comprising, a first circuit for calculating a length of one frame for the display according to one period of a vertical synchronizing signal which is introduced from an external device with an image signal, a second circuit for detecting a total number of sustaining pulses contained in one frame based on brightness information contained in said image signal, a third circuit for calculating a length of one driving period of the plasma display panel necessary for displaying one frame based on the total number of sustaining pulses detected by said second circuit, a fourth circuit for comparing results from said first circuit and said third circuit; and a fifth circuit for changing a total number of scan lines, which are scanned in line-sequence, according to a result from said comparing circuit.

12. The plasma display device according to claim 11, wherein said fifth circuit changes the total number of scan lines in a manner to reduce the same when said fourth circuit finds that the length of one frame obtained by the first circuit is shorter than the length of one driving period obtained by the third circuit.

13. The plasma display device according to claim 11, wherein said fifth circuit changes the total number of scan lines in a manner to increase the same when said fourth circuit finds that the length of one frame obtained by the first circuit is longer than the length of one driving period obtained by the third circuit.

14. The plasma display device according to claim 11, wherein said driving circuit is further comprised of a sixth circuit for detecting a lapse of a predetermined time period during which no change is detected once said fourth circuit has detected a change in a compared result, and wherein said fifth circuit changes the total number of scan lines after said sixth circuit detects the lapse of the predetermined time period.

15. The plasma display device according to claim 11, wherein said first circuit, said third circuit and said fourth circuit are comprised of a microprocessor unit and a recording media in which a program for making said microprocessor unit function as said first, third and fourth circuits is stored.

16. A plasma display device comprising:

a plasma display panel; and a driving part for driving the plasma display panel in a subframe mode in which one frame for display is divided into a plurality of subframes and a predetermined number of sustaining pulses is applied to the plasma display panel during each of the subframes so as to cause a sustaining discharge;

said driving part further comprising, a first circuit for calculating a length of one frame for display according to one period of a vertical synchronizing signal which is introduced from an external device along with an image signal, a second circuit for calculating a maximum number of sustain pulses to be displayed based on the length of one frame calculated by the first circuit and for calculating a maximum brightness according to the maximum number of sustaining pulses thus obtained;

a third circuit for detecting an agreement of the maximum brightness calculated by said second circuit with a referential brightness determined in advance; and a fourth circuit for calculating a number of sustaining pulses which corresponds to said referential brightness when no agreement is detected by said third circuit, and for setting the calculated number of sustaining pluses to be the maximum number of sustaining pluses.

17. A method for driving a plasma display device having a plasma display panel and a driving part for driving the plasma display panel in a subframe mode in which one frame for display is divided into a plurality of subframes and a predetermined number of sustaining pulses is applied to the plasma display panel during each of the subframes so as to cause a sustaining discharge, the driving method comprising the steps of:

calculating a length of one frame for display according to one period of a vertical synchronizing signal which is input from an external device along with an image signal;

detecting a total number of sustaining pulses contained in one frame based on a brightness information contained in said image signal;

calculating a length of one driving period of the plasma display panel necessary for displaying one frame based on the total number of sustaining pulses detected at the detecting step;

comparing the length of one frame with the length of one driving period obtained in the respective calculating steps; and changing a total number of sustaining pulses in one frame according to a compared result obtained in the comparing step.

* * * * *